US005807072A

United States Patent [19]

Payling

[11] Patent Number: 5,807,072

[45] Date of Patent: Sep. 15, 1998

[54] VARIABLE STATOR VANE ASSEMBLY

[75] Inventor: Stephen R. Payling, Fairfield, Ohio

[73] Assignee: General Electric Company, Cincinnati, Ohio

[21] Appl. No.: 723,161

[22] Filed: Sep. 25, 1996

Related U.S. Application Data

[62] Division of Ser. No. 560,059, Nov. 17, 1995, Pat. No. 5,622,473.

[51] Int. Cl.[6] ..... F04D 29/08

[52] U.S. Cl. ..... 415/170.1; 415/160; 277/206 R

[58] Field of Search ..... 415/160, 162, 415/164, 150, 170.1; 277/206 R, 205

[56] References Cited

U.S. PATENT DOCUMENTS

| | | | |
|---|---|---|---|
| 3,736,070 | 5/1973 | Moskowitz et al. . | |
| 3,887,297 | 6/1975 | Welchek . | |
| 3,901,517 | 8/1975 | Heathcott | 277/206 |
| 4,049,360 | 9/1977 | Snell . | |
| 4,348,032 | 9/1982 | Hanson et al. | 227/206 |
| 4,430,043 | 2/1984 | Knight et al. . | |
| 4,619,580 | 10/1986 | Snyder . | |
| 4,633,911 | 1/1987 | Lohn | 277/206 |
| 4,722,615 | 2/1988 | Bailey et al. | 277/206 |
| 4,812,106 | 3/1989 | Purgavie . | |
| 4,861,228 | 8/1989 | Todman . | |
| 4,867,635 | 9/1989 | Tubbs . | |
| 4,874,289 | 10/1989 | Smith, Jr. et al. . | |
| 4,978,280 | 12/1990 | Tubbs . | |
| 5,024,580 | 6/1991 | Olive . | |
| 5,039,277 | 8/1991 | Naudet . | |
| 5,042,245 | 8/1991 | Zickwolf, Jr. . | |
| 5,044,879 | 9/1991 | Farrar . | |
| 5,168,447 | 12/1992 | Moore . | |
| 5,308,226 | 5/1994 | Venkatasubbu et al. . | |
| 5,622,473 | 4/1997 | Payling | 415/160 |

*Primary Examiner*—John T. Kwon
*Attorney, Agent, or Firm*—Andrew C. Hess; Wayne O. Traynham

[57] ABSTRACT

A variable stator vane assembly which substantially eliminates leakage paths by utilizing a cantilevered finger spring seal and an o-ring is described. In one form, the stator vane assembly includes a spacer configured to form, with an upper, or outer, surface of the vane trunnion bushing, an annulus. The ring shaped cantilevered finger spring seal is positioned in the annulus and forms a seal between the spacer and trunnion bushing. The stator vane assembly also includes, in one form, an o-ring located at an interface between the stator case and the stator vane metal jacket.

9 Claims, 1 Drawing Sheet

VARIABLE STATOR VANE ASSEMBLY

This application is a division, of application Ser. No. 08/560,059, filed Nov. 17, 1995, now U.S. Pat. No. 5,622, 473.

FIELD OF THE INVENTION

This invention relates generally to gas turbine engines and more particularly, to a variable stator vane assembly for such engines.

BACKGROUND OF THE INVENTION

Known gas turbine engines typically include a high pressure compressor having spaced, rotatable blades. A plurality of variable stator vane assemblies are secured to the compressor stator casing and each assembly includes an air foil which extends between adjacent blades. The orientation of the air foils relative to the compressor blades is variable to control air flow through the compressor.

At least one known variable stator vane assembly includes a trunnion bushing partially positioned within a metal jacket. A portion of the air foil extends through the trunnion bushing. The assembly is bolted onto the compressor stator casing. Components of this known stator vane assembly can be removed without removing the top compressor casing and the bushing maintainability and wear life characteristics are good.

Although the known variable stator vane assembly provides certain advantages as explained above, such vane assembly has two possible gas stream leakage paths. The primary leakage path is between the outside diameter of the air foil and the inside diameter of the bushing. The secondary leakage path is between the outside diameter of the metal jacket and the inside diameter of the compressor stator case opening. Such leakage paths can result in an engine performance deficit, which is undesirable.

It would be desirable, of course, to provide a variable stator vane assembly, for use in connection with a high pressure compressor, which eliminates the above described leakage paths. It also would be desirable to provide such a variable stator vane assembly which can be removed without having to remove the top compressor casing.

SUMMARY OF THE INVENTION

These and other objects may be attained in a variable stator vane assembly which substantially eliminates the above described leakage paths by utilizing a cantilevered finger spring seal and an o-ring. More particularly, and in one form, the stator vane assembly includes a spacer configured to form, with an upper, or outer, surface of the vane trunnion bushing, an annulus. The ring shaped cantilevered finger spring seal is positioned in the annulus and forms a seal between the spacer and trunnion bushing.

The spring seal substantially eliminates the primary leakage path described above. In addition, the sealing efficiency of such spring seal increases as gas pressure increases due to the ballooning effect of the spring seal. Further, the spring seal has a large dimensional tolerance to ease manufacturing requirements, and by selecting the material of the spring seal to have a low coefficient of friction, such seal does not significantly increase the difficulty in adjusting the orientation of the air foil. Moreover, the spring seal also substantially eliminates the ingression of foreign particles into the bushing from outside the compressor, thus facilitating a longer bushing life and enhancing performance.

The stator vane assembly also includes, in one form, an o-ring located at an interface between the stator case and the stator vane metal jacket. More particularly, the trunnion bushing is located within the metal jacket and a chamfer is formed at the outer end of the vane opening in the stator case. The metal jacket and bushing assembly are positioned in the vane opening and the o-ring is positioned in the space between the metal jacket and vane opening at the location of the chamfer. The o-ring forms a seal between the stator case and the stator vane metal jacket and substantially eliminates the secondary leakage path described above.

The subject variable stator vane assembly, by substantially eliminating the primary and secondary leakage paths, is believed to enhance engine performance. In addition, with the subject assembly, since the ingression of foreign particles into the bushing is substantially eliminated, bushing life is believed to be increased. Moreover, the variable stator vane assembly can be removed without having to remove the top compressor casing.

DETAILED DESCRIPTION OF THE DRAWINGS

Figure 1:
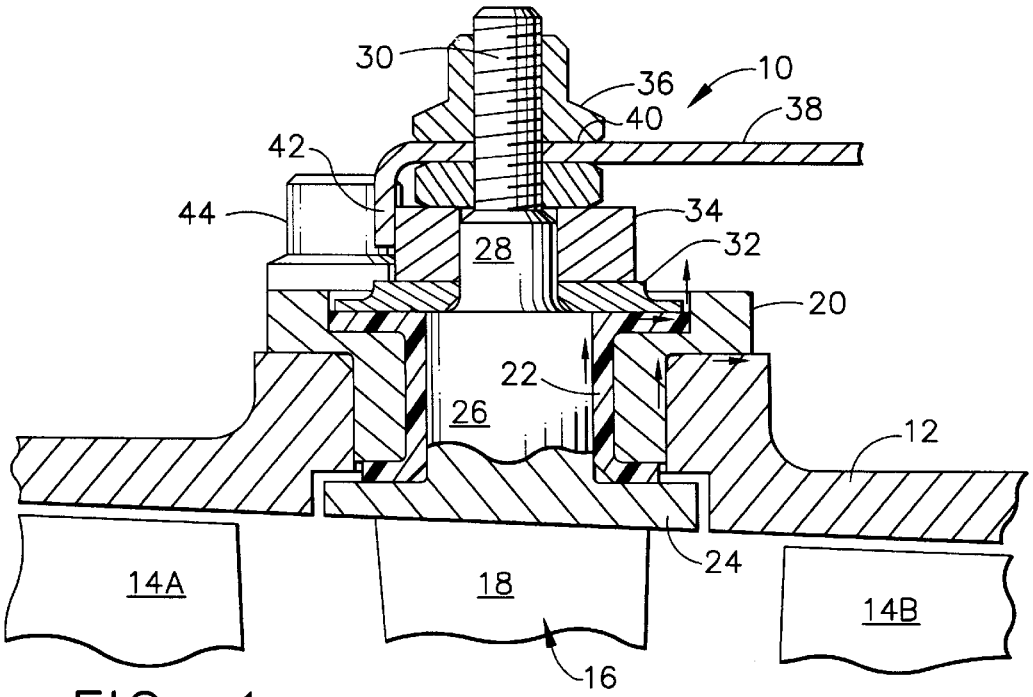
FIG. 1 (PRIOR ART)
FIG. 1 is a side view, in cross section, of a prior art variable stator vane assembly.

FIG. 1 is a side view, in cross section, of a known variable stator vane assembly 10 secured to a compressor casing 12. As is well known in the art, a compressor having rotating blades 14A and 14B is mounted within casing 12. An air foil assembly 16 includes a foil 18 which extends between rotating blades 14A and 14B. The angular orientation of foil 18 is adjustable relative to blades 14A and 14B to control air flow through the compressor. Stator vane assembly 10 also includes a metal jacket 20 housing a portion of trunnion bushing 22.

Air foil assembly 16 includes a platform 24 and a substantially cylindrical portion 26. Assembly 16 also includes spindle 28 having a threaded portion 30. Spindle 28 extends from, and is integral with, vane cylindrical portion 26. A spacer 32 is positioned between bushing 22 and a bearing 34. A threaded nut 36 is threadedly engaged to threaded portion 30 of spindle 28. A lever arm 38 extends through an opening 40 in nut 36 and is connected, at an L-shaped portion 42, to bearing 34. A bolt 44 secures assembly 10 to casing 12.

In operation, the orientation of air foil 18 can be adjusted by lever arm 38. Lever arm 38 may be coupled, by a unison ring, to lever arms of other vane assemblies. In this manner, the orientation of a plurality of air foils can be adjusted in unison.

Although known variable stator vane assembly 10 provides certain advantages as explained above, such vane assembly 10 has two possible gas stream leakage paths generally indicated by arrows in FIG. 1. The primary leakage path is between the outside diameter of air foil 16 and the inside diameter of bushing 22. The secondary leakage path is between the outside diameter of metal jacket 20 and the inside diameter of the vane opening in compressor stator case 12. Such leakage paths can result in an engine performance deficit, which is undesirable.

Figure 2:
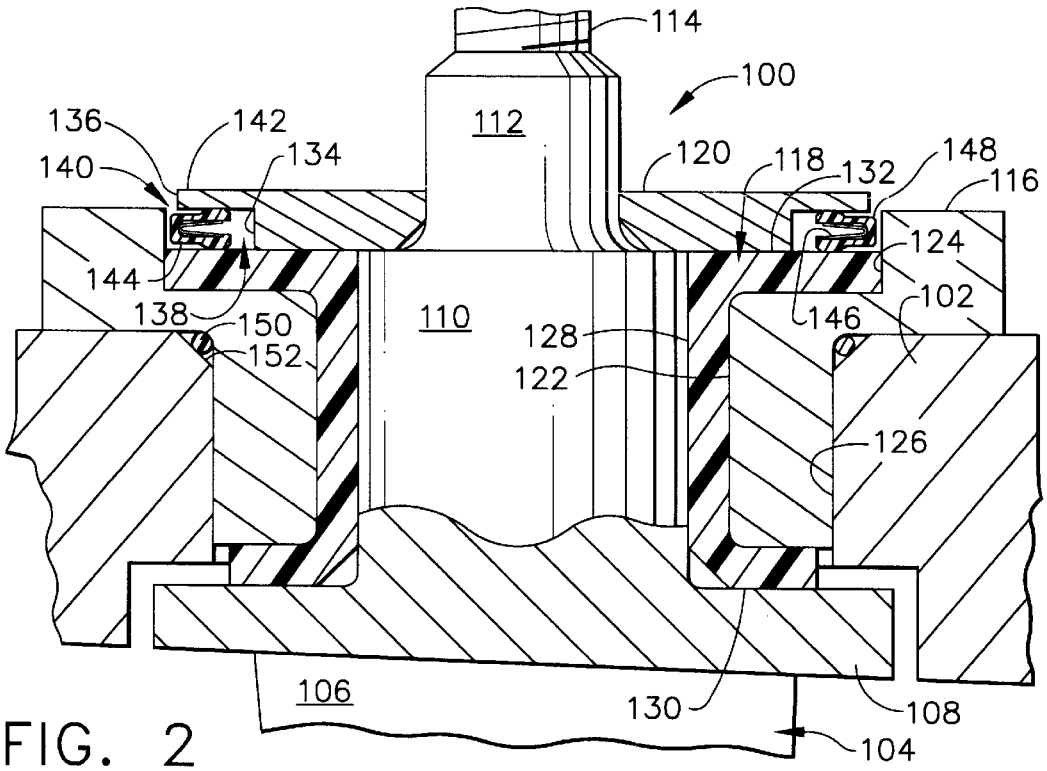
FIG. 2 is a side view, in cross section, of a variable stator vane assembly in accordance with one embodiment of the present invention.

A variable stator vane assembly 100 which eliminates the above described leakage paths in accordance with one embodiment of the present invention is shown in FIG. 2. Certain components are cut-away in FIG. 2, but it should be understood that such components are substantially identical to the components shown in FIG. 1, e.g., nut 36, lever arm 38, and bolt 44. Assembly 100 secured to compressor case 102, includes an air foil assembly 104 having an air foil 106, a platform 108 and a substantially cylindrical portion 110. A spindle 112 which includes a threaded portion 114 extends from cylindrical portion 110. Assembly 100 further includes a metal jacket 116 substantially housing a trunnion bushing 118. A spacer 120 is secured to spindle 112.

Metal jacket 116 has a first substantially cylindrical shaped portion 122 and a second substantially cylindrical shaped portion 124. First portion 122 is sized to be at least partially inserted within opening 126 in case 102 and at least a portion of an outer surface of first substantially cylindrical shaped portion 122 is sized to be in substantial surface to surface contact with compressor casing 102.

Bushing 118 has a central portion 128 and first and second end portions 130 and 132. At least a portion of an outer surface of bushing 118 sized to be in substantial surface to surface contact with an inner surface of metal jacket 116.

Spacer 120 includes a substantially cylindrical portion 134 having a first diameter and a flange portion 136 having a second diameter. The first diameter of portion 134 is less than the second diameter of flange portion 136. Cylindrical portion 134 and flange portion 134 cooperate with second end portion 132 of bushing 118 to establish an annulus 138.

A spring loaded seal 140 is positioned within annulus 138. Seal 140 has a substantially u-shaped compressed configuration in which respective legs 142 and 144 of seal 140 are pressed against surfaces of spacer flange portion 136 and bushing second end portion 132. Spring loaded seal 140 is oriented within annulus 138 so that the open end of seal 140 between legs 142 and 144 faces towards spacer cylindrical portion 134. Spring loaded seal 140 includes a cantilevered finger spring 146 secured to a flexible teflon seal 148. Spacer 120 is rotatable relative to spring loaded seal 140.

If a gas enters annulus 138 and flows from the open end of spring seal legs 142 and 144 to the closed end thereof, seal 140 will expand towards the open end of annulus 138. Second cylindrical portion 124 of metal jacket 116 at least partially covers the open end of annulus 138 and limits expansion of spring loaded seal 140.

An o-ring seal 150 is positioned between the outer surface of metal jacket 116 and a surface of compressor casing 102 at least adjacent air foil opening 126. A chamfered surface 148 is formed in compressor casing 102 at an upper portion of air foil opening 126, and o-ring seal 146 is located on at least a portion of chamfered surface 152. 0-ring seal 146 is, in one embodiment, silicone.

Spring seal 140 substantially eliminates the primary leakage path and o-ring 146 substantially eliminates the secondary leakage path described above and the sealing efficiency of spring seal 140 increases as gas pressure increases due to the ballooning effect. Also, spring seal 140 has a large dimensional tolerance to ease manufacturing requirements, and by selecting the material of the spring seal to have a low coefficient of friction, seal 140 does not significantly increase the difficulty in adjusting the orientation of air foil 106. Spring seal 140 also substantially eliminates the ingression of foreign particles into bushing 118 from outside the compressor, thus facilitating a longer bushing life and enhancing performance.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A seal assembly for a variable stator vane assembly of a gas turbine engine, the engine including a compressor housed within a compressor casing, an air foil opening formed in the casing, the variable stator vane assembly including a metal jacket, a bushing having a central portion and first and second end portions, at least a portion of an outer surface of the bushing sized in substantial surface to surface contact with an inner surface of the metal jacket, an air foil assembly including an air foil, and a spacer cooperating with the bushing to establish an annulus, said seal assembly comprising a spring loaded seal positioned within the annulus, said seal having a substantially u-shaped compressed configuration in which respective legs of said seal are pressed against surfaces of the spacer and bushing.

2. A seal assembly in accordance with claim 1 wherein said spring loaded seal is oriented within the annulus so that the open end of said seal between said legs faces towards a cylindrical portion of the spacer.

3. A seal assembly in accordance with claim 2 wherein if a gas enters the annulus and flows from the open end of said spring loaded seal legs to the closed end thereof, said seal expands towards the open end of the annulus.

4. A seal assembly in accordance with claim 3 wherein the metal jacket at least partially covers the open end of the annulus and limits expansion of said spring loaded seal.

5. A seal assembly in accordance with claim 1 wherein said spring loaded seal comprises a cantilevered finger spring secured to a flexible teflon seal.

6. A seal assembly in accordance with claim 1 wherein said spacer is rotatable relative to said spring loaded seal.

7. A seal assembly in accordance with claim 1 further comprising an o-ring seal positioned between the outer surface of the metal jacket and a surface of the compressor casing at least adjacent the air foil opening.

8. A seal assembly in accordance with claim 7 wherein a chamfered surface is formed in the compressor casing at an upper portion of the air foil opening, and said o-ring seal is located on at least a portion of the chamfered surface.

9. A seal assembly in accordance with claim 7 wherein said o-ring seal is silicone.

* * * * *